United States Patent [19]

Vavrinec

[11] 3,938,747

[45] Feb. 17, 1976

[54] CHUCK HEAD WITH ROTATABLE FEEDING MOVEMENT

[75] Inventor: Bohuslav Vavrinec, Prague, Czechoslovakia

[73] Assignee: Tesla, narodni podnik, Prague, Czechoslovakia

[22] Filed: Feb. 22, 1974

[21] Appl. No.: 444,844

[30] Foreign Application Priority Data

Mar. 9, 1973 Czechoslovakia ..... PB1728-73

[52] U.S. Cl. ..... 242/4 C

[51] Int. Cl.[2] ..... H01F 41/08

[58] Field of Search ..... 242/4 C, 4 R; 179/22, 35

[56] References Cited

UNITED STATES PATENTS

| | | | |
|---|---|---|---|
| 2,467,643 | 4/1949 | Wirth | 242/4 C |
| 2,726,817 | 12/1955 | Barrows | 242/4 C |
| 3,383,059 | 5/1968 | Fahrbach | 242/4 C |
| 3,587,988 | 6/1971 | Jagos | 242/4 C |
| 3,618,868 | 11/1971 | Vavrinec | 242/4 C |
| 3,669,365 | 6/1972 | Loturco | 242/4 C |

*Primary Examiner*—Edward J. McCarthy

[57] ABSTRACT

A chuck head with rotatable feeding movement for clamping of small toroid cores in the course of winding a conductor on this core comprises three supporting rollers of the toroid, two of which are stable, the third tiltable and spring loaded, all these rollers receiving a drive at constant circumferential speed. Means for correct feeding of the wound on conductor are equally provided.

6 Claims, 6 Drawing Figures

CHUCK HEAD WITH ROTATABLE FEEDING MOVEMENT

BACKGROUND OF THE INVENTION

This invention relates to a chuck head for a rotatable feeding movement of a clamped ring shaped body, for instance of a ferrite toroid core, wound on on a microtoroid winding machine. The arrangement represents a unit, which can be used as additional replaceable part of a microtoroid winding machine.

Actually used microtoroid winding machines enable an automatic winding of miniature toroids up to a minimum external diameter of about 4 mm. For winding of toroid cores of a smaller external diameter, for instance 2.5 mm only, a special exchangeable additional arrangement, a chuck head with a rotatable feeding movement had to be designed.

The arrangement now used for clamping and feeding of toroids had the toroid core, on which the conductor had to be wound, clamped between three guiding rollers, one of which was idle running, tiltable, designed for securing pressure only, whereas the remaining two rollers received a step by step rotating motion from the shaft of a ratchet wheel by way of a toothed gear. The shafts of the driven rollers together with the rollers and their pinions have been arranged rotatably between two flat parallel side walls, forming the supporting structure of the clamping device. This arrangement did not allow the winding of very small toroids, because their clamping required already the use of clamping rollers of very small diameters situated at rather limited axial distances. Any reduction of the axial distances of clamping rollers caused difficulties of the design of the discriminating device, used for winding the conductor on the core, the arm of which had to be brought as close as possible to the face of the wound on toroid. The reduction of the axial distance of the clamping rollers has been in known designs of microtoroid winding machines limited by the circumstance that the arm of the discriminating device had to perform working movements between the shafts of the clamping rollers and bearing parts of these shafts. The rotatable feeding of very small toroids with a step by step drive of only two of three clamping rollers has not been reliable due to slipping. This drawback could not been eliminated by application of a larger pressure of the pressure roller both because of the brittleness of very small toroids and because very small toroids have been in case of larger pressures pressed into the rubber lining of the clamping rollers what additionally affected the conditions for a reliable feeding movement of the toroid.

SUMMARY OF THE INVENTION

It is an object of this invention to provide a clamping head with a rotating feeding movement which would enable a safe clamping of small and brittle toroids in the course of their winding and their reliable rotation according to requirements. It is another object of this invention to enable an easy access to the chuck head both for inserting the toroid core for winding and for manipulation in the course of winding. There is a further object to provide a safe guiding of the conductor used for winding on the toroid core.

The chuck head according to this invention for clamping and rotatably feeding a toroid has a base wall and a front plate parallel therewith, connected by distance pieces and supporting therebetween a front shaft and a rear shaft. A further supporting shaft is arranged with the front and rear shaft. A tiltable bracket is supported by the supporting shaft, which bracket supports in turn a lateral shaft rotatable thereupon. Rollers for clamping the toroid are fixed to extending parts of the front, rear and tiltable shaft. Gear means are provided to transmit to the front and rear shaft a rotating movement at uniform speed and in the toroid winding direction. Transmission gear means is provided on the supporting shaft to transmit rotation to the lateral shaft. The roller on the lateral shaft is urged in engagement with the toroid to be clamped by spring means forcing the bracket toward the base wall. The rollers for clamping the toroid are fixed exchangeably on their shafts. Feeding means for a correct feeding of the wound on conductor are provided.

DESCRIPTION OF DRAWINGS

An examplary embodiment of the chuck head according to this invention is indicated in the attached drawings, where.

DESCRIPTION OF PREFERRED EMBODIMENT

Figure 1:
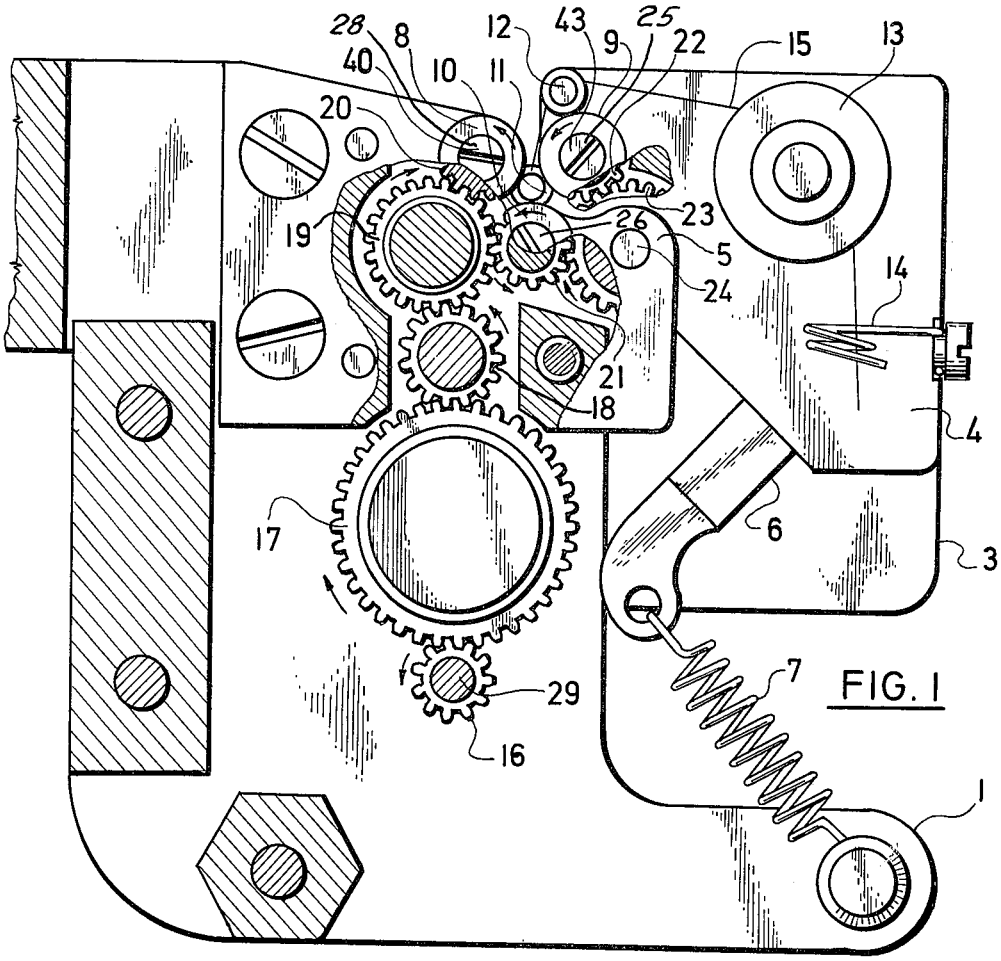
FIG. 1 is a side view of the proper chuck means with parts in section.
Figure 3:
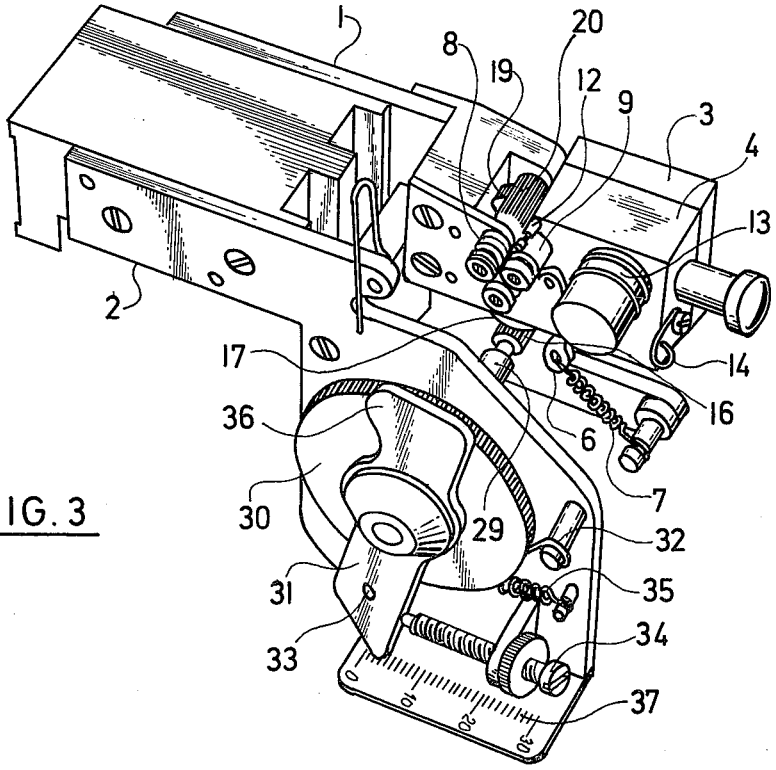
Figure 2:
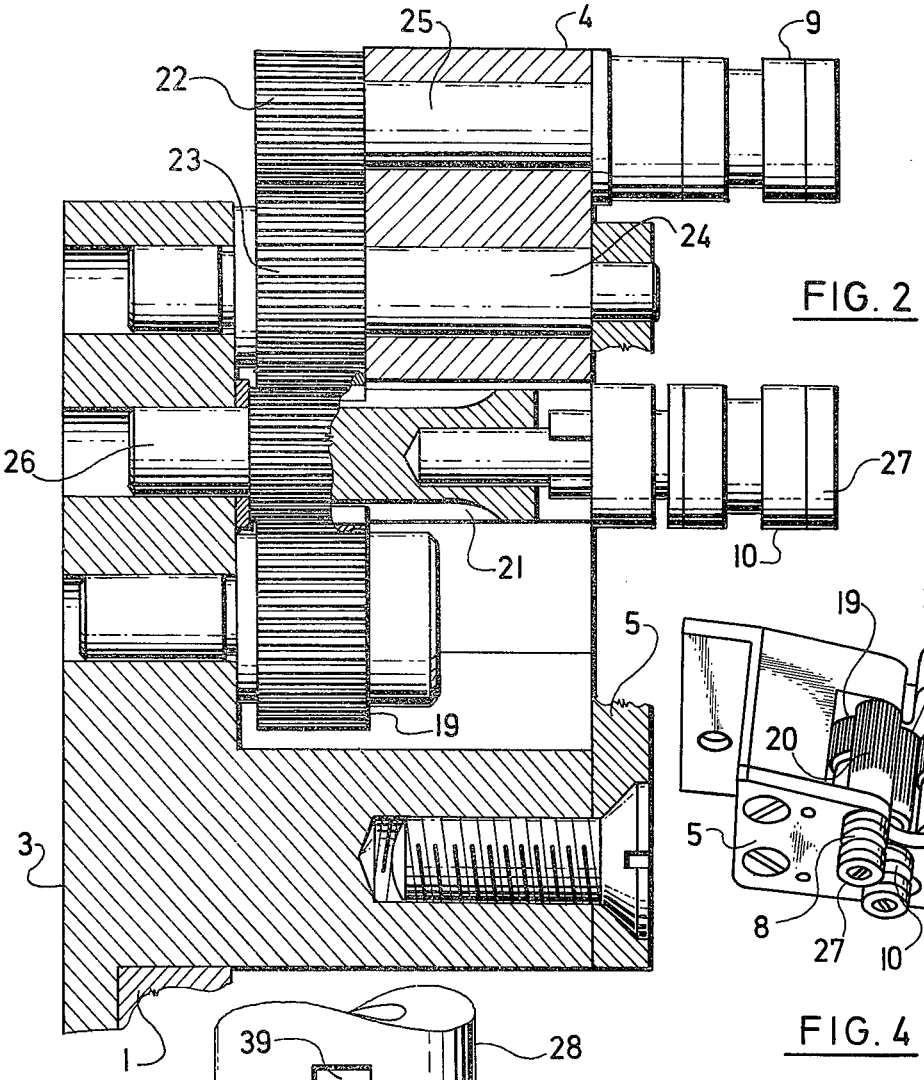
FIG. 2 is a sectional top view of the chuck head in its tilted position, FIG. 3 a perspective view of the whole chuck head, FIG. 4 a perspective view of the removable clamping part of the chuck head, FIG. 5 the front supporting roller of the toroid in longitudinal section and FIG. 6 the same view of the tiltable supporting roller of the toroid.
Figure 4:
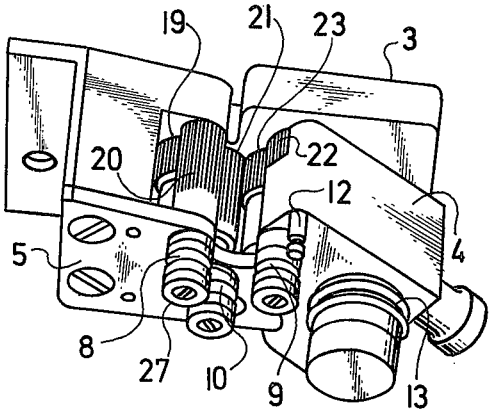

The chuck head according to this invention comprises a base wall 3 and a front plate 5 parallel therewith, mutually connected by distance pieces. A front shaft 28 and a rear shaft 26 are rotatably supported between this base wall 3 and front plate 5. There is a further supporting shaft 24 parallel with the front and rear shaft supported by the base wall 3 and the front plate 5. This supporting shaft 24 supports a tiltable bracket 4 which in turn supports a lateral shaft 25 rotatable thereupon and being equally parallel with shafts 24, 26 and 28. A front supporting roller 8 for the toroid to be clamped is exchangeably fixed to the end of the front shaft 28 extending over the front plate 5, a rear supporting roller 10 is similarly fixed to the rear shaft 26 and a lateral supporting roller 9 is fixed to the lateral shaft 25. The whole unit just described is by means of the base wall 3 fixed to a support wall 1 of the whole chuck head so that it can be easily replaced by another similar unit. The rear beveled part of the tiltable bracket 4 has an extension 6 where one end of a pull spring 7 is anchored, the other end of which is fixed to an extension of the support wall 1 of the chuck head. The pull spring 7 urges the tiltable bracket 4 and thus also the lateral roller 9 in engagement with the toroid core 11.

A face wall 2 extending over the gearing means is fixed by means of distance members to the support wall 1 and is located and shaped to leave a free space in front of the supporting rollers 8,9 and 10 of the torroid core 11.

A driving shaft 29 of the chuck head is freely rotatably supported between the support wall 1 and the face wall 2 and extends over the latter.

A ratchet wheel 30 is fixed on the extending part of the driving shaft 29, and, on the hub thereof, a two arm lever 31 is rotatably seated, same having a driving pawl 33 rotatably arranged on one arm thereof and a projection 36 for transmission of a rocking movement to the two arm lever 31 by a not shown cam mechanism on its other arm. A pull spring 35 fixed with one end to the stud of the driving pawl 33 and with its other end to the face wall 2 urges said one arm of the two arm lever 31 against an adjustable stop screw 34, which determines the rest position of the two arm lever 31. A locking pawl 32 engaging with the ratchet wheel 30 is furthermore rotatably supported on a stud fixed to the face wall 2. The extent of the rocking motion of the two arm lever 31 is determined by the position of the stop screw 34 and can be read on a scale 37 fixed to the face wall 2, with which scale 37 a pointer on the end of said one arm of the two arm lever 31 cooperates.

A driving pinion 16 is fixed to the other end of the driving shaft 29 meshing with a first transmission wheel 17, which in turn engages with a second transmission wheel 18 on a stud fixed to the base wall 3 which meshes with a third transmission wheel 19 supported in a similar way. The third transmission wheel 19 transmits a rotating movement to a front pinion 20 on the front shaft 28 and to a rear pinion 21 on the rear shaft 26. The rear pinion meshes furthermore with a transmission wheel 23 coaxial with the supporting shaft 24 of the tiltable bracket 4, which transmission wheel 23 is in engamenet with a pinion 22 on the lateral shaft 25.

The tiltable bracket 4 rests in its disengaged position, i.e. when a toroid core 11 has to be inserted between the supporting rollers 8, 9, 10 with the beveled wall of its rear part against a distance piece located between the base wall 3 and the front plate 5. A guiding stud 12 is furthermore provided on the lateral wall of the tiltable bracket 4 in front of the tiltable roller 9 somewhat above the axis of the clamped toroid core 11, and has a groove for guiding the starting end of the conductor wire 15 to be wound, and possibly also of taps. A holding roller 13 is provided on the same side of the tiltable bracket 4 where the guiding stud 12 is located. A guiding eyelet 14 for leading the conductor wire 15 to, and securing it against shifting from, the holding roller 13 is provided on the tiltable bracket 4 at a place preceding the holding roller 13.

Figure 5:
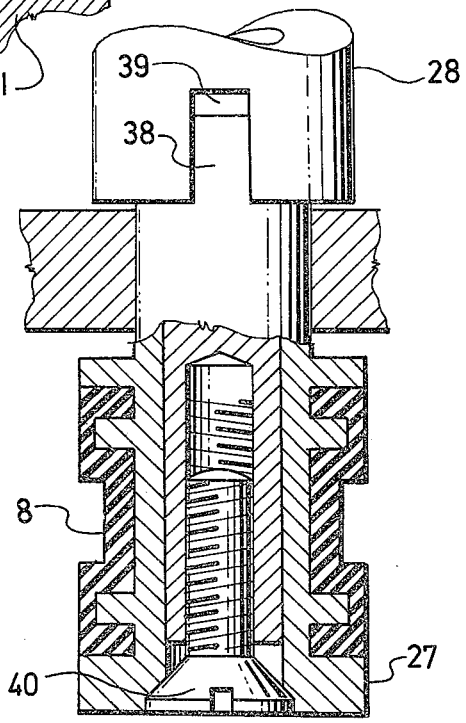
Figure 6:
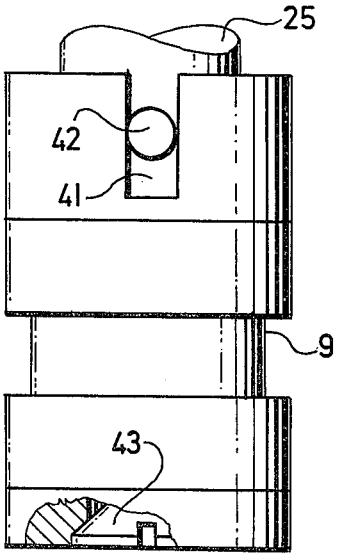

FIG. 5 and 6 show how the supporting rollers of the toroid are fixed exchangeably on their shafts. According to FIG. 5 the front roller 8 is by means of a sleeve 27 shifted on a stud like extension of the front shaft 28, engaging by tooth shaped extensions 38 of the sleeve 27 into grooves 39 of the front shaft 28. The position of the sleeve 27 is secured by a screw 40, pressing the rear face of the sleeve 27 against a collar of the front shaft 28. The active surface of the roller 8 is provided with a rubber lining, fixed to the sleeve 27.

FIG. 6 shows another example of fixing of these rollers with regard to the lateral supporting roller 9 for the toroid core 11 on the lateral shaft 25. This shaft in engagement with cuts 41 of the sleeve shaped tiltable roller 9, being pressed by a screw 43 against a collar formed by a stud like extension of the tiltable shaft 25. The active surface of the roller 9 can be of course equally provided with a rubber lining.

In the description of the examplary embodiment a step by step rotatable feeding movement of the clamped toroid core has been considered. This feeding movement can be of course also continuous, so far it meets the requirements of the winding process. In that case the drive by means of the ratchet wheel 30 is replaced by a simple transmission gear.

In operation first the tiltable bracket 4 is turned back and an empty toroid core 11 is inserted so that it rests by its front and rear end respectively on the front roller 8 and on the rear roller 10. The tiltable bracket 4 is thereafter allowed to return into its operating position, whereby the tiltable roller 9 rests against the inserted toroid core 11, against which it is urged by the force of the pull spring 7. Thus the toroid core 11 is securely clamped and the winding operation can be started. The step by step rotating movement is transmitted to the toroid by the action of a not shown cam mechanism against a projection 36 of the two arm lever 31, which takes along in the course of one of its strokes by means of the driving pawl 33 the ratchet wheel 30, which is in the course of the rear stroke of the two arm lever 31 secured in its position by the locking pawl 32. The step by stop movement of the ratchet wheel 30 is transmitted via the driving shaft 29, the gearing means 17, 18, 19 to the front pinion 20 on the front shaft 28 and thus to the front supporting roller 8 of the toroid core 11 and simultaneously to the rear pinion 21 on the rear shaft 26 and thus also to the rear supporting roller 10 of the toroid 11. The rear pinion 21, meshing with the transmission gear 23 coaxial with the supporting shaft 24 enables to transmit the rotating motion also to the tiltable pinion 22 on the lateral shaft 25 and thus also to the lateral supporting roller 9 of the toroid core 11, so that at any circumstance all supporting rollers 8, 9, 10 of the toroid 11 are driven at uniform circumferential speed and in the direction of the toroid winding speed.

The guiding stud 12 and the holding roller 13 with the guiding eyelet 14 enable a safe guiding of the conductor wire 15 being wound.

The access to the active parts of the chuck head is easy, the unit with the supporting rollers 8, 9, 10 of the toroid core is easily exchangeable, equally as the supporting rollers 8, 9, 10 themselves.

I claim:

1. A chuck for winding a conductor wire into a toroid comprising a frame having a base wall and a spaced front plate parallel therewith, a front shaft and a rear shaft rotatably journalled within said base wall and front plate, a rotatable core on which said wire is wound into a toroid, said core being located between said front and rear shafts, a first and second toroid clamping rollers mounted respectively on each of said front and rear shafts, said first and second toroid clamping rollers being adapted to engage therebetween the wire toroidally wound on said core, a supporting shaft rotatably journalled between the base wall and the front plate spaced from and parallel with the front and rear shaft, a bracket pivotally supported by said supporting shaft, a lateral shaft journalled on said bracket, a third clamping roller mounted on said lateral shaft, said lateral shaft being positioned on said bracket to move toward and away from said frame on pivoting said bracket, so that said third supporting roller is adapted to selectively engage the surface of said wire wound on said core, and spring means for normally biasing said bracket toward said frame, transmission means for simultaneously rotating the front, rear and lateral shafts at a uniform speed and in the direction of rotation of said core, so that said clamping rollers cooperate to rotate the wire wound on said core, and motor means for driving said gear means.

2. The chuck according to claim 1, wherein the transmission means comprises a gear attached to each of said front, rear and lateral shafts and intermediate gears connected to said drive means.

3. The chuck according to claim 1, wherein the first and second rollers are fixed on extensions of their respective shafts projecting over the front plate parallel to the base wall of the chuck.

4. The chuck according to claim 1, wherein the clamping rollers are removably fixed to their respective shafts.

5. The chuck according to claim 1, wherein said transmission means includes means for indexing the rotation of said shafts in step-by-step arrangement.

6. The chuck according to claim 1, including means for guiding the wire to be wound over said third clamping roller, comprising a stud having a groove for receipt of said wire, a groove wheel and an eyelet, said stud, wheel and eyelet being sequentially arranged on a side wall of said bracket.

* * * * *